US009151032B2

(12) United States Patent
Zwicker et al.

(10) Patent No.: US 9,151,032 B2
(45) Date of Patent: Oct. 6, 2015

(54) SHOWER ARM FOR SHOWER WC

(71) Applicant: GEBERIT INTERNATIONAL AG, Jona (CH)

(72) Inventors: Maurus Zwicker, Eschenbach (CH); Rolf Weiss, Tann (CH)

(73) Assignee: GEBERIT INTERNATIONAL AG, Jona (CH)

( * ) Notice: Subject to any disclaimer, the term of this patent is extended or adjusted under 35 U.S.C. 154(b) by 0 days.

(21) Appl. No.: 14/371,124

(22) PCT Filed: Feb. 13, 2013

(86) PCT No.: PCT/EP2013/000416

§ 371 (c)(1),
(2) Date: Jul. 8, 2014

(87) PCT Pub. No.: WO2013/120605

PCT Pub. Date: Aug. 22, 2013

(65) Prior Publication Data

US 2015/0020302 A1 Jan. 22, 2015

(30) Foreign Application Priority Data

Feb. 16, 2012 (EP) ..... 12001036

(51) Int. Cl.

| | |
|---|---|
| ***E03D 9/08*** | (2006.01) |
| ***B05B 1/34*** | (2006.01) |
| ***B05B 7/04*** | (2006.01) |

(52) U.S. Cl.
CPC . *E03D 9/08* (2013.01); *B05B 1/341* (2013.01); *B05B 7/0425* (2013.01)

(58) Field of Classification Search
CPC ..... E03D 9/08
USPC ..... 4/443–448
See application file for complete search history.

(56) References Cited

U.S. PATENT DOCUMENTS 5,826,282 A 10/1998 Matsumoto et al.

FOREIGN PATENT DOCUMENTS

| | | | |
|---|---|---|---|
| DE | 10 2008 019930 | A1 | 10/2008 |
| EP | 1 627 966 | A1 | 2/2006 |
| GB | 288349 | A | 4/1928 |
| WO | 2006/059065 | A1 | 6/2006 |

OTHER PUBLICATIONS

International Search Report for PCT/EP2013/000416 dated Apr. 10, 2013.

International Preliminary Report on Patentability dated Aug. 19, 2014 from the International Searching Authority in counterpart application No. PCT/EP2013/000416.

*Primary Examiner* — Lori Baker
(74) *Attorney, Agent, or Firm* — Sughrue Mion, PLLC

(57) ABSTRACT

A shower arm for a shower WC or a bidet comprising a spherical swirl chamber for generating swirl in the shower jet and a corresponding shower device and a corresponding shower WC.

16 Claims, 4 Drawing Sheets

SHOWER ARM FOR SHOWER WC

Figure 1A:
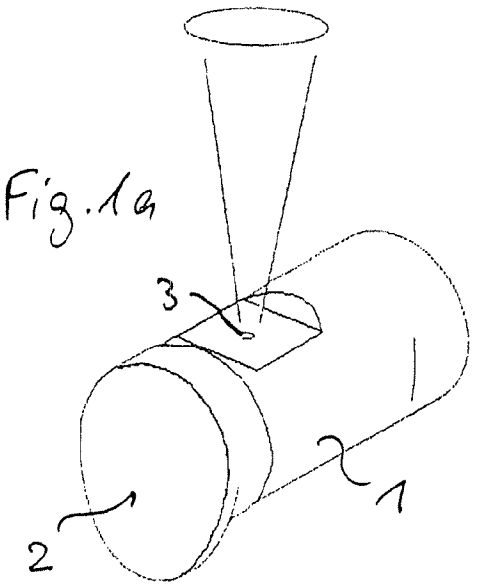

The present invention relates to a shower arm for a shower WC or a bidet.

CROSS REFERENCE TO RELATED APPLICATIONS

This application is a National Stage of International Application No. PCT/EP2013/000416 filed Feb. 13, 2013, claiming priority based on European Patent Application No. 12001036.8filed Feb. 16, 2012, the contents of all of which are incorporated herein by reference in their entirety.

FIELD OF THE INVENTION

WCs (water closets) comprising a shower device for cleaning the user have been known and widely used for a long time. Generally the shower device has a moveable shower arm which for cleaning can be moved from a totally or partially concealed position into a bowl of the WC and after cleaning can be moved back again. By means of the movement the shower arm should on the one hand be able to reach a favourable position for the discharge of shower water directed at the lower body of the user, and on the other hand it is protected from contamination and damage in the retracted position when not in use. However, a movement of the shower arm is not absolutely necessary, although customary.

BACKGROUND OF THE INVENTION

Furthermore, prior art already exists relating to swirl chambers in a water supply pipe of this type of shower arm for supplying shower water to a shower nozzle. This type of swirl chamber is intended to generate a rotating flow of water, in particular in order to widen the jet of water passing out of the shower nozzle by means of the centrifugal forces.

The technical problem underlying the present invention is to specify an improved shower arm with a swirl chamber, a shower WC equipped with the latter and a shower device for this WC.

SUMMARY OF THE INVENTION

According to the invention the problem is achieved by a shower arm for a shower WC or bidet comprising a shower nozzle from which shower water can pass in the direction of and for cleaning a user of the shower WC, a pipe for supplying water to the nozzle and a swirl chamber in the water supply pipe for generating rotating water flows in shower water delivered to the nozzle, characterised in that the swirl chamber is a spherical chamber with an internal dimension greater than that of a section of the water supply pipe directly preceding the spherical chamber and is spherical in shape apart from an inlet opening and an outlet opening of the water supply pipe and any edge cross-overs at these openings, and by a shower WC equipped with the latter, a shower device equipped with the latter and by the corresponding use of the shower arm.

Therefore, according to the invention a so-called spherical chamber is provided here as a swirl chamber which, as the name suggests, has a spherical internal form. Exceptions to this are of course the inlet openings and outlet openings of the water supply pipe which cause there to be interruptions in the spherical form. Edges occurring here can cause further deviations from the spherical form, in particular in the form of roundings or bevels for improving the flow ratios.

The typical pipe cross-section of the spherical chamber should basically be widened with respect to the water supply pipe, in particular in the section directly preceding the inlet opening. In a typical circular cross-section of the water supply pipe the typical internal diameter or inside radius of the spherical chamber should therefore be greater than that of the water supply pipe, in particular of the directly preceding section; with cross-sectional forms of the water supply pipe deviating from this, this applies accordingly to a typical diameter of the water supply pipe. Thus, the flow cross-section therefore widens as the shower water enters into the spherical chamber, and the spherical chamber provides swirl for the water flow. In any event, the water retains this swirl to a substantial extent up to the shower nozzle itself, and so it shapes the jet of shower water on the way to the user. It can thereby provide a pulsating massage feeling and/or a widening of the shower jet and/or an improved washing effect by means of flow components transverse to the main outlet direction of the jet.

Preferred here is the case of precisely one water supply pipe, i.e. precisely one inlet opening and precisely one outlet opening on the spherical chamber, even though more than one inlet opening and/or more than one outlet opening are basically also conceivable.

In trials carried out by the inventor the spherical chamber proved to be a particularly effective form of swirl chamber that is easy to produce.

Furthermore, the swirl chamber preferably lies close to the shower nozzle, i.e. preferably clearly closer to the shower nozzle than to the opposite end of the water supply pipe in the shower arm so that the swirls are largely or sufficiently maintained before the shower water passes out of the shower nozzle. However, a further water pipe section is located between the actual shower outlet surface and the spherical chamber in order to form a good jet, preferably.

Furthermore, the water supply pipe passes at an angle of preferably 65° to 115° relative to the main outlet direction of the shower water at the nozzle into the spherical chamber, i.e. at a right angle plus/minus 25°. More preferable are deviations of at most 20°, 15°, 10° and even only 5° from the right angle. The change in direction of the water flow by almost a right angle has proved to be of value because the water then tends to swirl with an axis of rotation approximately parallel to the main outlet direction of the nozzle, and this is advantageous with regard to widening the jet.

Furthermore, at least the section of the water supply pipe directly preceding the spherical chamber preferably lies approximately parallel to the longitudinal direction of the shower arm, an angle deviation of at most 20° and even better at most 15°, 10° or even 5° being preferred. Therefore, a favourable geometry for the arrangement of the water supply pipe within the shower arm and, with the preferred angular arrangement between the water supply pipe in front of and behind the spherical chamber, a water outlet from the shower arm approximately transverse to the latter are provided.

Furthermore, in this invention a centric arrangement of the inlet opening of the water supply pipe at the spherical chamber relative to the spherical chamber is preferred, on the one hand with regard to a direction that lies perpendicular both to the main outlet direction of the nozzle and to the water pipe section directly preceding the spherical chamber and, additionally or alternatively, with regard to a direction parallel to the nozzle outlet direction. The centric arrangement with regard to the latterly specified direction (parallel to the nozzle outlet direction) promotes pronounced swirl within the spherical chamber. The centric arrangement in relation to the previously specified direction (perpendicular to the main nozzle outlet direction and perpendicular to the water supply pipe in front of the spherical chamber) provides, in contrast to the prior art (with eccentric inflow of a swirl chamber in this regard), alternating swirl states in the spherical chamber with different, in particular almost opposite, directions of rotation.

It has become apparent that with this centric inflow a swirl direction or a direction of rotation, for example, does not evolve more or less randomly and then be maintained, but that the flow in this respect "tips over" again and again in a chronological sequence, similarly to a bistable flip-flop circuit in electrical engineering. These alternating swirl states also shape the shower jet after the shower water passes out of the shower nozzle. This results in a particularly pronounced massage feeling for the user because of the pulsation.

Furthermore, the centrifugal forces in the intermediate phases between particularly pronounced swirls in a specific direction are smaller and/or intermixed by non-uniform flow states so that at the temporal average not only a jet widening, but also particularly good coverage of the internal region of the area covered by the shower jet takes place. The inventor has established that concentration upon jet widening by means of centrifugal forces as a result of swirl in the shower jet conceals the risk that a hollow cone jet, as it were, or in any event a shower jet with a small washing effect will be produced in its internal region. This can be effectively countered by the alternating swirl states.

It has already been mentioned that the cross-over edges between the spherical chamber and the inlet open and the outlet opening do not have to be sharp. In particular, a rounding on the outlet opening is preferred here. The typical radius of this rounding (which does not necessarily have to correspond exactly to circular segment shapes in the section) is preferably between 0.3 times and 3 times the inside radius of the spherical chamber. The following lower limits are increasingly preferred in this order: 0.5 times, 0.7 times and 0.8 times; furthermore, the following upper limits are increasingly preferred in the following order: 2 times, 1.5 times and 1.2 times the inside radius of the spherical chamber.

In this way interruptions at the cross-over of the swirled flow from the spherical chamber can be reduced by the outlet opening to the nozzle. At the inlet opening this type of rounding is not of the same importance because the flow ratios in the spherical chamber with respect to the inflow are in any case re-defined.

Furthermore, it has likewise already been mentioned that the spherical chamber is intended to increase the effective flow cross-section with respect to the directly preceding water supply pipe section. In particular, a ratio of the inside radius of this pipe section (as the numerator) and the inside radius of the spherical chamber itself (as the denominator) of between 0.3 and 0.9 is preferred, lower limits of 0.4 and 0.5 and upper limits of 0.8, 0.7 and 0.6 being increasingly preferred in this order.

The cross-sectional form of the preceding section of the water supply pipe can also deviate here from the circular form, in particular if the largest internal diameter (for example the long axis of an ellipse or the diagonal of a rectangle) is no larger than the diameter of the spherical chamber. Then, with regard to the radius ratio, the average radius is to be taken. Circular pipe cross-sections are preferred, however.

The cross-section of the water pipe between the spherical chamber and the actual nozzle outlet opening is at the most as large as that of the water pipe directly in front of the spherical chamber. However, it can also partially be in the form of a nozzle, i.e. tapering. One preferred configuration of the nozzle tapers continuously from the spherical chamber to the nozzle outlet opening. Therefore, the water pipe between the spherical chamber and the nozzle outlet opening forms here overall a nozzle and accelerates the speed component of the water jet in the main discharge direction due to the cross-section reduction. One preferred configuration of this taper is conical, the cross-over between the spherical chamber and this conical form being able to be rounded, as already mentioned. Reference is made to the first exemplary embodiment for an explanation.

According to a further configuration of the invention there is provided at the nozzle opening at least one flow guide rib, preferably a number of ribs, for example, as in the exemplary embodiment, six. These flow ribs project inwards from an inner wall and affect the water flow. They are preferably straight, i.e. they are not turned in the sense of additional swirl, and they can be inclined in relation to the main discharge direction of the shower jet (in the sense of a reduction or increase of the distance to the centre axis of the show nozzle). These flow guide ribs can, if so desired, somewhat calm the swirled flow without totally eliminating the swirl states. In particular, they can serve to mix air into the shower jet by interacting with the swirl states. This mixing in of air is desirable because the water thus becomes more finely distributed, and the shower jet acts, as it were, "more volumically" without the water consumption being increased.

In a further configuration the shower nozzle is provided with at least one air supply channel, i.e. a further pipe for air discharging from the outside into the water pipe in the region of the shower nozzle. More advantageously, the air can be sucked in by the flow in the shower nozzle according to the water jet pump principle. The air supply channel or channels can basically also introduce this air from other sides of the shower arm; it is preferred, however, if the air supply channels are made to be relatively short and discharge next to the nozzle outlet surface for the shower water, i.e. also suck in the air to be supplied here. For the sake of illustration, reference is also made here to the exemplary embodiment, namely to the third.

BRIEF DESCRIPTION TO THE DRAWINGS

In the following the invention will be described in more detail using exemplary embodiments, the individual features also being able to be important in different combinations and relating to all of the claim categories.

FIGS. 1*a-d* show a nozzle-side end of a shower arm according to the invention in a perspective view, in a top view, as a longitudinal section and finally a section from this longitudinal section.

FIGS. 2*a-d* show corresponding views for a second exemplary embodiment, and FIGS. 3*a-d* corresponding views for a third exemplary embodiment.

Figure 4:
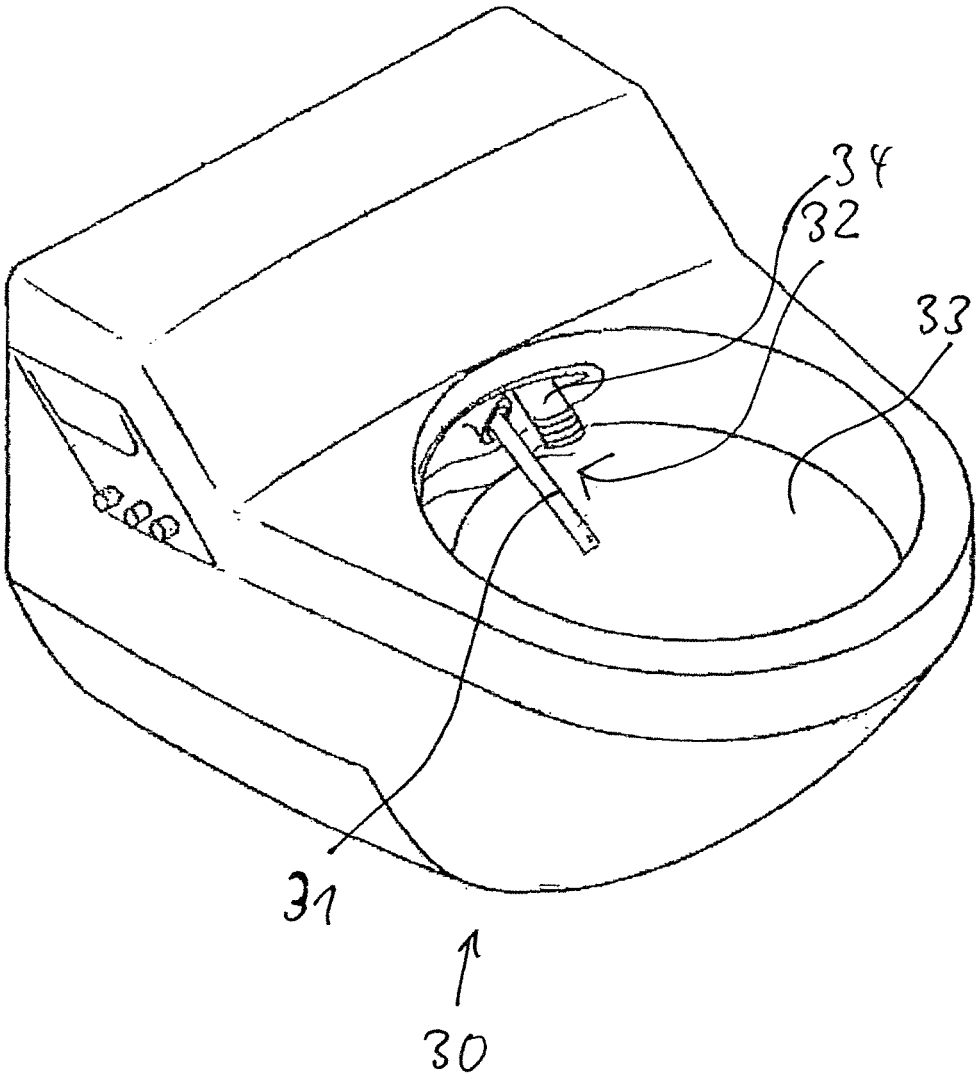

FIG. 4 shows a shower WC with a shower device according to the invention.

DETAILED DESCRIPTION OF THE INVENTION

FIGS. 1*a-d* show a first exemplary embodiment, namely the distal end of a shower arm 1. This distal end can be designed, for example, as a detachable nozzle head 1 and be applied to a further section of the shower arm that only has the function of supporting and the function of conveying. The shower head 1 is therefore pushed into the bowl from a rear (wall-side or cistern-side) region of a flushing edge or the wall of a flushing wall-free WC bowl during operation and then projects, with a slight downwards incline, into the opening of the WC bowl. The incline corresponds to an angle between a (in FIGS. 1*c* and 1*d* horizontal) longitudinal direction of the shower arm and the horizontal of approximately 5° so that the face surface 2 that can be seen in FIGS. 1*a-c* stands vertically in the operating state.

Figure 1B:
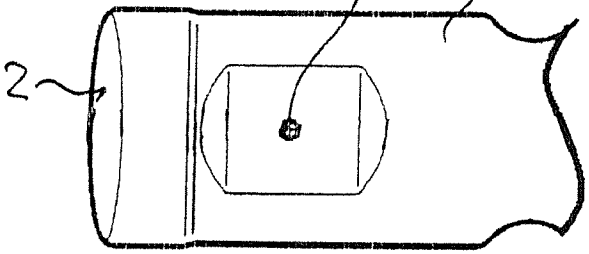
Figure 1C:
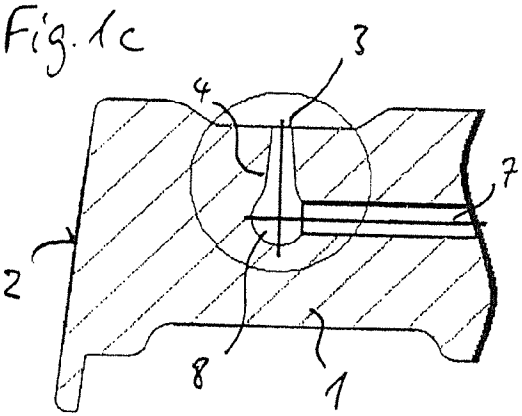
Figure 1D:
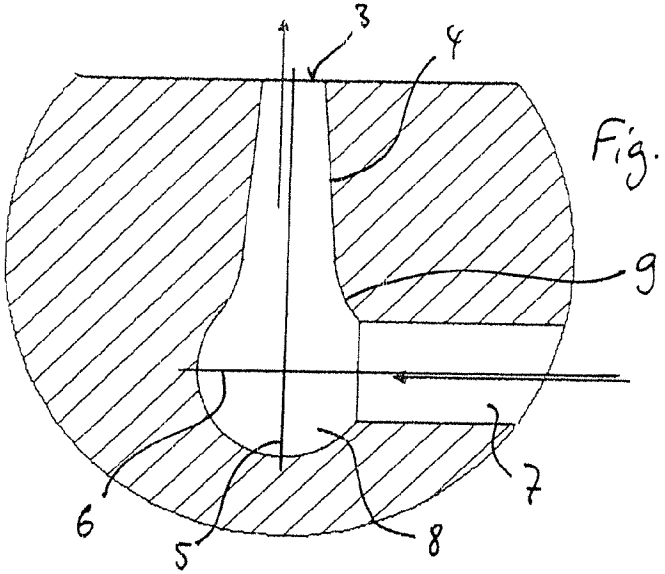

FIGS. 1*a-d* show a nozzle outlet surface 3 on the upper side of the shower head 1, and FIGS. 1*c* and 1*d* show in section (enlarged in FIG. 1*d*) a conical shower nozzle 4 arranged upstream of this nozzle outlet surface 3. The latter is directed perpendicularly upwards in relation to the longitudinal direction of the shower arm, i.e. inclined forwards by approximately 5° with respect to the vertical in the operating position of the shower arm. With its longitudinal direction it defines a main outlet direction of the shower jet. This is identified by number 5 in FIG. 1*d*, and the longitudinal direction of the shower arm by 6. The line indicating the longitudinal direction of the shower arm 6 in FIG. 1*d* is at the same time a longitudinal centre axis of a water supply pipe 7, along which, as indicated by the arrow in FIG. 1*d*, shower water flows along the shower arm, is deflected upwards and passes out to the top through the shower nozzle 4, as also indicated by an arrow, along the main outlet direction 5. The connecting piece between the latter and the means for deflecting between the section of the water pipe 7 shown in FIG. 1*d* is a spherical chamber 8 shown in section in FIGS. 1*c* and 1*d* which is spherical apart from the circular inlet opening of the water pipe 7 (on its right edge in FIGS. 1*c* and 1*d*) and a cross-over 9 to the nozzle 4 (on its upper edge in FIGS. 1*c* and 1*d*). The cross-over 9 is rounded, with a radius of curvature of approximately 2.5 mm. The inside radius of the spherical chamber 8 is 2.2 mm and the inside radius of the water supply pipe 7 is 1.25 mm. The conical nozzle 4 tapers from an inside radius of 1.17 mm to 0.775 mm.

The water supply pipe 7 meets the spherical chamber centrically, both with regard to the vertical in FIGS. 1*c* and 1*d* and relative to the direction perpendicular to the plane of the drawing (and so to the vertical in FIG. 1*b*).

Due to the inflow of the water flow from the water supply pipe 7 into the spherical chamber 8 alternating turbulent flows occur here with a dominant swirl the axis of rotation of which lies approximately parallel to the main outlet direction 5 and so to the longitudinal axis of the conical nozzle 4. The direction of rotation of this main swirl is continuously reversed by the constantly changing swirl. These swirl states are largely maintained in the flow as it passes through the nozzle 4 and passes out of the nozzle outlet surface 3, the water flow being accelerated by the taper in the nozzle 4.

Above the nozzle outlet surface 3 the centrifugal forces caused by the swirls can become effective and widen the shower jet, as indicated in FIG. 1*a*. It approximately forms a sphere, this sphere being pulsated figuratively speaking with regard to its opening width and with regard to the portion of the water in the core and on the edge of the sphere. In particular, the sphere edges are covered more greatly and the opening width of the sphere becomes larger if a particularly pronounced swirl state prevails and the middle is covered more greatly and the complete jet is narrower in the cross-overs in between. In particular, these pulsations can take place so quickly that on the section between the nozzle outlet surface 3 and the surface of the user's body to be cleaned a plurality of different swirl states and cross-over states are "on the move" in between. Therefore, the "sphere" then has an interrupted or no longer cohesive coat. The user feels a pulsating water jet that seems to be "soft" and that has a good cleaning effect as a result of the pronounced speed components of the water transverse to the main outlet direction 5.

The inventor's trials have shown that the flow speed of the water is not particularly essential for the desired pulsating swirl sequence. This flow speed determines the intensity of the swirl in the sense that the opening angle of the shower jet passing out tends to increase as the flow speed increases. For the exemplary embodiments flow rates in the order of magnitude of 1 to 1.5 l/min are preferred, for the present relatively thin dimensions of the water supply pipe 7 the relatively low flow rate of 1 l/min being considered as favourable. However, it is advantageous for the formation of the desired flow states that the inside radius of the spherical chamber 8 is greater than the inside radius of the preceding section of the water supply pipe 7. In this exemplary embodiment the conical nozzle form of the nozzle 4 and the rounded cross-over between the spherical chamber 8 and the nozzle 4 receive a particularly large amount of the turbulent flow states and "brake" the latter comparatively little.

FIGS. 2*a-d* show one version as a second exemplary embodiment. Here corresponding elements are identified by reference numbers that correspond to FIGS. 1*a-d*, the number 10 being added respectively. Therefore, the face surface 2 from FIG. 1*c* corresponds to the face surface 12 of FIG. 2*c*. In this exemplary embodiment the tilt angle already described is larger, namely approximately 15°; the shower arm 11 is therefore more greatly inclined. Here too the face surface 12 stands vertically in the operating state. Moreover, the quantitative details regarding the radii also apply here and also to the third exemplary embodiment.

Figure 2B:
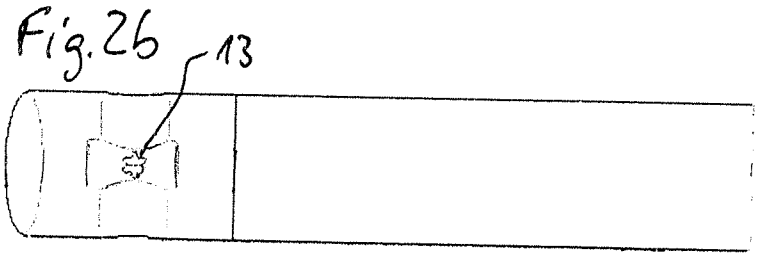
Figure 2D:
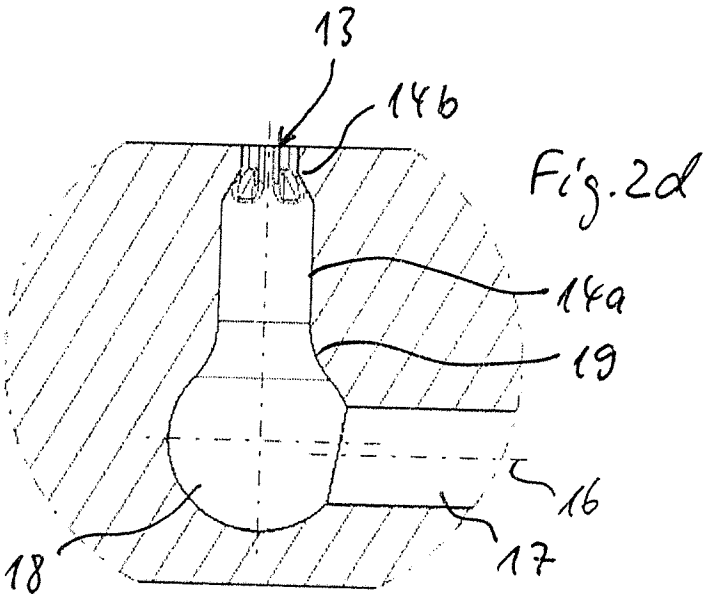
Figure 2A:
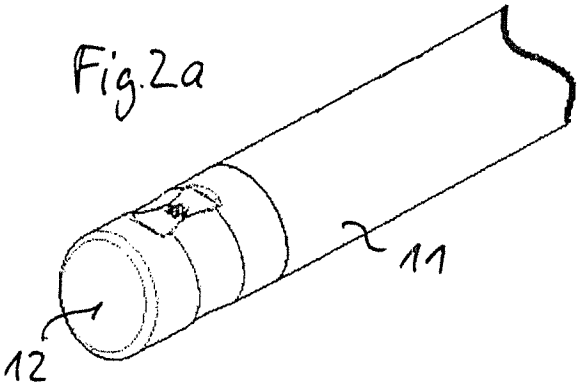
Figure 2C:
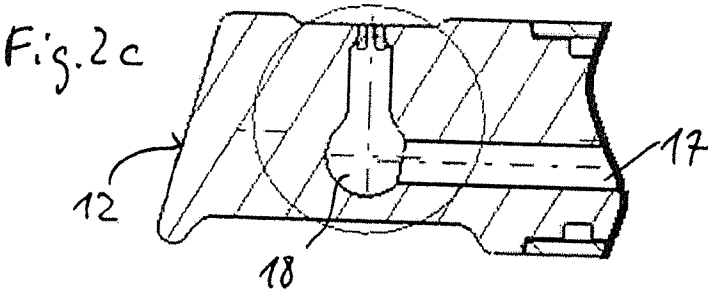

In this second exemplary embodiment one can see in FIG. 2*c* on the right edge on the outside of the shower arm 11 a pipe section that corresponds to the rest of the shower arm and into which the shower arm head shown here is inserted. Within the pipe section one can see the groove for a corresponding seal.

In addition to the greater incline just mentioned, a difference with respect to the first exemplary embodiment is that the nozzle 14 is of a different form. It does not extend over a comparable vertical length. Instead, adjoining by means of a rounding 19 corresponding to the first exemplary embodiment is a straight cylindrical pipe section 14*a* that basically corresponds to a section of water pipe. Moreover, the nozzle tapers conically in a region 14*b* over a short section in order to run over a further, even shorter section, again cylindrically, i.e. in a straight line, see FIG. 2*d*. However, this description only corresponds to the inwardly pointing surfaces of six ribs that can be seen in FIG. 2*b* which project into the pipe line section from the outside. The cylindrical pipeline section (according to 14*a*) passes upwards without any interruption between the ribs as far as the nozzle outlet opening 13.

The actual nozzle 14*b*, i.e. the taper in front of the outlet surface, along with the ribbed structure serves here not only to accelerate the flow—less than the conical structure 4 from the first exemplary embodiment. Rather, the swirl states are calmed somewhat in order to generate a shower jet which is overall somewhat smoother, more uniform and less pulsating. At the same time, in the interplay between the ribs in the nozzle 14*b* and the swirl state air additions occur, the air originating from the nozzle outlet surface 13. This is comparable with a so-called aerator in a conventional water tap.

Moreover, FIG. 2*d* shows a certain vertical offset between the longitudinal centre axis 16 of the water supply pipe 17 and the centre point of the spherical chamber 18. This offset is 0.4 mm here, i.e. approximately a third of the radius of the water supply pipe 17 (of 1.25 mm). The inventor has experimented with such vertical deviations. They do not significantly disrupt the desired bistable swirl in the spherical chamber 18, in any case provided these deviations are no greater than the radius difference between the water supply pipe 17 and the spherical chamber 18. In individual cases it may be desired with such vertical deviations to take into account specific spatial factors within the shower arm 11. However, a centric arrangement is preferred because it is favourable for the flow and easy to produce.

Moreover, slight deviations from the centric arrangement in the direction perpendicular to the plane of the drawing of FIG. 2*d* are basically also conceivable, but can lead to a constant swirl with just one direction of rotation, in particular when a largely tangential inflow is achieved, i.e. when the offset in this direction is as great as the radius difference. Offset sections which are small in comparison (or even just inaccuracies) are not detrimental however.

The third exemplary embodiment is shown in FIGS. 3*a-d*. Reference can largely be made once again to the comments made above. Accordingly, the same reference numbers as in the previous figures are drawn in, the number range between 21 and 29 being used here. The face surface (on the left in FIGS. 3*b* and 3*c*) is therefore identified for example by 22 instead of by 2 or 12. Here it is once again at the same angle of approximately 5° to the vertical in FIGS. 3*b* and 3*c* as in the first exemplary embodiment.

Figure 3B:
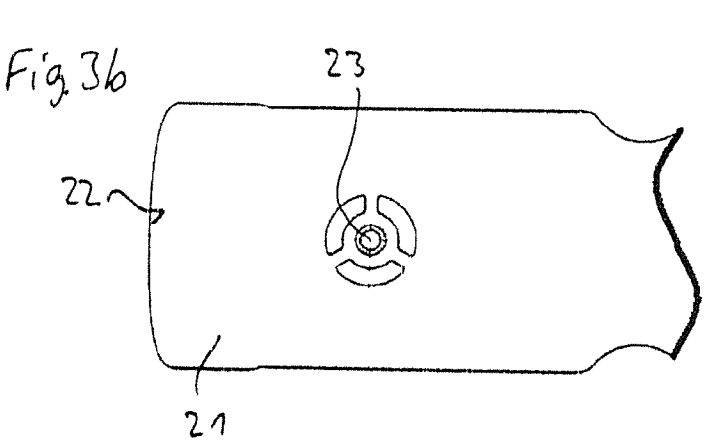
Figure 3D:
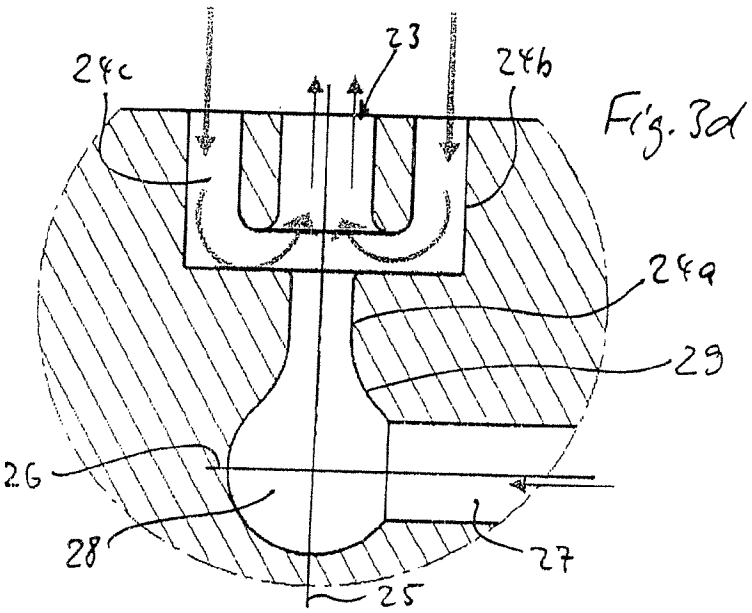
Figure 3A:
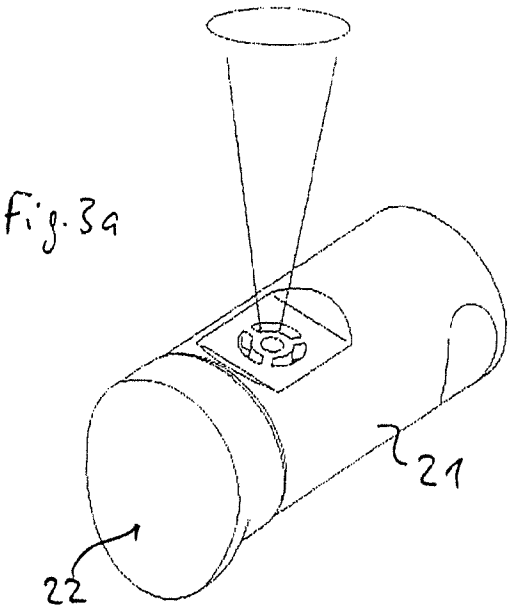
Figure 3C:
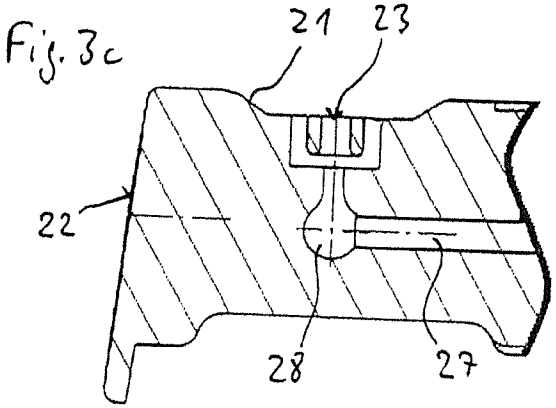

Moreover, the third exemplary embodiment corresponds to the second in so far as a straight cylindrical section 24*a* once again adjoins here over the spherical chamber 28 after a cross-over 29 with a rounding. Over this there is a nozzle 24*b* with air supply channels 24*c*. FIGS. 3*a* and 3*b* show that these channels 24*c* are provided in triplicate and are grouped like ring segments around a nozzle outlet surface 23. They can suck air in through their openings next to the nozzle outlet surface 23 and convey this into the water flow in the nozzle 24*b* after a corresponding reverse in direction according to the arrows in FIG. 3*d*. The principle of the water jet pump is applied here. In consideration of the correspondingly increased volume of the water jet the pipe cross-section for the water jet in the actual region of the nozzle 24*b*, i.e. between the air supply channels, is increased. The nozzle outlet surface 23 therefore has a larger cross-section than the water pipe section 24*a* between the nozzle 24*b* and the spherical chamber 28.

With regard to the maintenance of the turbulent flow states from the spherical chamber 28 in the shower jet itself, in principle what has been stated with regard to the first and the second exemplary embodiments applies. The turbulences are calmed less here than by the straight flow rib nozzle 14*b* of the second exemplary embodiment, however also somewhat more greatly disrupted than by the smooth conical structure of the nozzle of the first exemplary embodiment. In this version a particularly large amount of air is supplied and so a particularly "more volumic" and apparently gentler shower jet is produced.

For the sake of simplicity, a single shower nozzle, in particular for anal cleaning, is shown for all three exemplary embodiments. The invention can of course basically also be implemented with a plurality of shower nozzles, also in the same shower arm. These shower nozzles could then be arranged in a row along the longitudinal direction of the shower arm. In particular, a vaginal nozzle can be combined with an anal nozzle, for the first of these, for example, a tilted alignment being able to ensure that a larger anatomical distance between the areas to be cleaned is taken into account despite a relatively small distance between the two nozzles.

FIG. 4 shows a perspective illustration of a shower WC 30 that is conventional with the exception of the shower arm 31. This shower WC 30 has a WC bowl 33 and adjoining this, to the rear left in FIG. 4, a housing structure for a shower device identified sweepingly here by 32. The shower device projects from the housing structure into the WC bowl 33 in the form of the aforementioned shower arm 31 and a dryer arm 34 drawn in next to it. Both the shower arm 31 and the dryer arm 34 can be extended and retracted and serve to clean and dry the user after using the shower WC 30 in the known manner.

Furthermore, a water heater, in particular a continuous-flow heater, is provided for the shower water in the housing structure, and furthermore a ventilator with a fan heater for the dryer air of the dryer arm 34. The shower device 32 can moreover have an odour extraction system and various other previously known equipment features and is operated by means of a control panel on one side of the housing structure shown on the left in FIG. 4.

The shower device 32 shown and the entire shower WC 30 are characterised by a shower arm 31 according to the invention, the end of which pointing to the bottom right in FIG. 4 may correspond to any of the preceding exemplary embodiments. The corresponding water supply pipe 7, 17 and 27 runs along the entire visible length of the shower arm 31 shown in FIG. 4.

The invention claimed is:

1. A shower arm (31) for a shower WC (30) or bidet comprising:

a shower nozzle (4, 14*b*, 24) from which shower water can pass in the direction of and for cleaning a user of said shower WC (30);

a water supply pipe (7, 17, 27) for supplying water to said nozzle (4, 14*b*, 24) and a swirl chamber (8, 18, 28) in said water supply pipe (7, 17, 27) for generating rotating water flows in shower water delivered to said nozzle (4, 14*b*, 24); and a water pipe portion (4, 14*a*, *b*, 24*a*) between said swirl chamber (8, 18, 28) and a nozzle outlet opening of said shower nozzle (4, 14*b*, 24), said water pipe portion having a cross-section being at the most as large as that of said water supply pipe (7, 17, 27) directly in front of said swirl chamber (8, 18, 28), wherein said swirl chamber is a spherical chamber (8, 18, 28) with an internal dimension greater than that of a section of said water supply pipe (7, 17, 27) directly preceding said spherical chamber (8, 18, 28) and is spherical in shape apart from an inlet opening and an outlet opening of said water supply pipe (7, 17, 27) and any edge cross-overs at these openings.

2. The shower arm (31) according to claim 1, wherein said section of said water supply pipe (7, 17, 27) directly preceding said spherical chamber (8, 18, 28) encloses an angle of between 65° and 115° with a main nozzle outlet direction (5, 15, 25) of the shower water.

3. The shower arm (31) according to claim 1, wherein said section of said water supply pipe (7, 17, 27) directly preceding said spherical chamber (8, 18, 28) encloses an angle of between 0° and 20° with a longitudinal direction (6, 16, 26) of said shower arm (31).

4. The shower arm (31) according to claim 1, wherein said section of said water supply pipe (7, 17, 27) directly preceding said spherical chamber (8, 18, 28) meets said spherical chamber (8, 18, 28) centrically in relation to a direction that is perpendicular to said main nozzle outlet direction (5, 15, 25) and to this section of said water supply pipe (7, 17, 27).

5. The shower arm (31) according to claim 1, wherein said section of said water supply pipe (7, 17, 27) directly preceding said spherical chamber (8, 18, 28) meets said spherical chamber (8, 18, 28) centrically relative to a direction parallel to said main nozzle outlet direction (5, 15, 25).

6. The shower arm (31) according to claim 1, wherein cross-over edges at the outlet opening of said spherical chamber (8, 18, 28) are rounded and preferably have a radius that is between 0.3 times and 3 times the inside radius of said spherical chamber (8, 18, 28).

7. The shower arm (31) according to claim 1, wherein an inside radius of said section of said water supply pipe (7, 17, 27) directly preceding said spherical chamber (8, 18, 28) and an inside radius of said spherical chamber (8, 18, 28) itself are at a ratio of between 0.3 and 0.9 to one another.

8. The shower arm (31) according to claim 1, wherein said shower nozzle (4) has an inner cross-section that tapers continuously from said spherical chamber (8) to said nozzle outlet opening (3) and is preferably conical in form, with the exception of edge roundings at the outlet opening on said spherical chamber (8).

9. The shower arm (31) according to claim 1, wherein said shower nozzle (14*b*) is provided with at least one, preferably a number of straight flow guide ribs corresponding to said main nozzle outlet direction (15).

10. The shower arm (31) according to claim 1, wherein there are provided in a partial section (24*a*) of said water supply pipe (27) between said spherical chamber (28) and said nozzle outlet surface (23) at least one, preferably a plurality of lateral air supply channels (24*c*) which convey air into the shower water flow.

11. The shower arm (31) according to claim 10, wherein said air supply channel or channels (24*c*) draw in air from at least one air inlet opening next to said nozzle outlet surface (23).

12. A shower device (32) for a shower WC (30) or a bidet comprising a water heater and comprising a shower arm (31) according to claim 1.

13. A shower WC (30) comprising a shower device (32) according to claim 12 and a WC bowl (33).

14. A shower WC (30) according to claim 13, wherein in the operating state said shower arm (13) is inclined with its longitudinal direction (6, 16, 26) dropping down at an angle of 2° to 30° to the horizontal towards said shower nozzle (4, 14*b*, 24).

15. The use of a shower arm (31) comprising:

a shower nozzle (4, 14*b*, 24) from which shower water can pass in the direction of and for cleaning a user of said shower WC (30);

a water supply pipe (7, 17, 27) for supplying water to said nozzle (4, 14*b*, 24) and a swirl chamber (8, 18, 28) in said water supply pipe (7, 17, 27) for generating rotating water flows in shower water delivered to said nozzle (4, 14*b*, 24); and a water pipe portion (4, 14*a, b*, 24*a*) between said swirl chamber (8, 18, 28) and a nozzle outlet opening of said shower nozzle (4, 14*b*, 24), said water pipe portion having a cross-section being at the most as large as that of said water supply pipe (7, 17, 27) directly in front of said swirl chamber (8, 18, 28), wherein said swirl chamber is a spherical chamber (8, 18, 28) with an internal dimension greater than that of a section of said water supply pipe (7, 17, 27) directly preceding said spherical chamber (8, 18, 28) and is spherical in shape apart from an inlet opening and an outlet opening of said water supply pipe (7, 17, 27) and any edge cross-overs at these openings, and wherein said shower arm is used for a shower device (32) according to claim 12.

16. The use of a shower arm (31) comprising:

a shower nozzle (4, 14*b*, 24) from which shower water can pass in the direction of and for cleaning a user of said shower WC (30);

a water supply pipe (7, 17, 27) for supplying water to said nozzle (4, 14*b*, 24) and a swirl chamber (8, 18, 28) in said water supply pipe (7, 17, 27) for generating rotating water flows in shower water delivered to said nozzle (4, 14*b*, 24); and a water pipe portion (4, 14*a, b*, 24*a*) between said swirl chamber (8, 18, 28) and a nozzle outlet opening of said shower nozzle (4, 14*b*, 24), said water pipe portion having a cross-section being at the most as large as that of said water supply pipe (7, 17, 27) directly in front of said swirl chamber (8, 18, 28), wherein said swirl chamber is a spherical chamber (8, 18, 28) with an internal dimension greater than that of a section of said water supply pipe (7, 17, 27) directly preceding said spherical chamber (8, 18, 28) and is spherical in shape apart from an inlet opening and an outlet opening of said water supply pipe (7, 17, 27) and any edge cross-overs at these openings, and wherein said shower arm is used for a shower WC (30) according to claim 13.

* * * * *